United States Patent [19]

Georgopoulos

[11] Patent Number: 5,002,113

[45] Date of Patent: Mar. 26, 1991

[54] TILT WAND ATTACHMENT FOR WINDOW BLINDS

[75] Inventor: George Georgopoulos, Pine Brook, N.J.

[73] Assignee: Levolor Corporation, Sunnyvale, Calif.

[21] Appl. No.: 411,324

[22] Filed: Sep. 22, 1989

[51] Int. Cl.[5] ..... E06B 9/26

[52] U.S. Cl. ..... 160/176.1; 160/178.1; 24/682; 24/698.1; 24/704.1

[58] Field of Search ..... 160/176.1, 178.1, 900; 24/265 H, 230.5 W, 573, 598, 599; 403/282, 406, 326, 361, 375, 71; 446/120

[56] References Cited

U.S. PATENT DOCUMENTS

| | | | |
|---|---|---|---|
| 3,425,479 | 2/1969 | Lorentzen et al. | 160/176.1 |
| 3,528,079 | 9/1970 | Birch | 446/120 X |
| 4,386,644 | 6/1983 | Debs | 160/176.1 X |
| 4,487,243 | 12/1984 | Debs | 160/176.1 X |
| 4,507,831 | 4/1985 | McClure | 160/177 X |
| 4,628,979 | 12/1986 | Hsu | 160/176.1 X |

*Primary Examiner*—Blair M. Johnson
*Attorney, Agent, or Firm*—Skjerven, Morrill, MacPherson, Franklin, & Friel

[57] ABSTRACT

An interconnection is provided for the tilt wand of a window blind. The interconnection includes a connector having a worm gear on one end and a transverse aperture extending through the opposed end. The aperture is formed to define opposed major and minor dimensions. The minor dimension is defined by a pair of opposed arcuate ribs formed in the aperture. The interconnection further includes a hook having a mounting end which also includes opposed major and minor dimensions. The mounted end is further configured to be urged past the arcuate ribs with appropriate deflection of the connector. However, rearwardly facing portions of the major dimensions area on the hook are configured to securely lock the hook in the transverse aperture of the connector. The interconnection further includes a sleeve for retaining the hook in its locked condition and a tilt wand which is engageable on the hook.

5 Claims, 3 Drawing Sheets

FIG.2
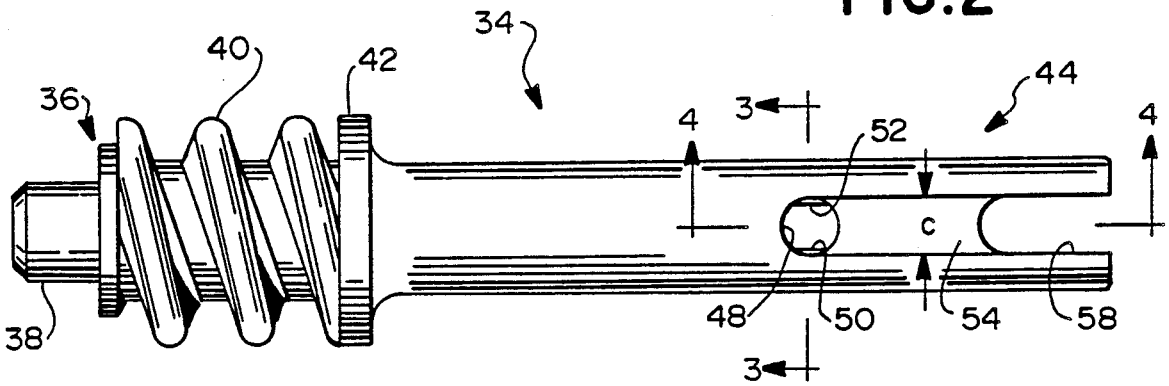
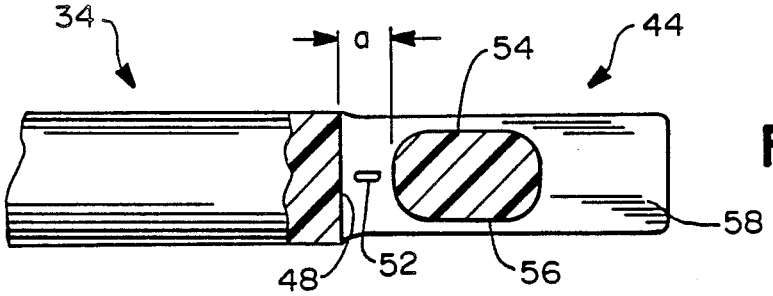
FIG.4
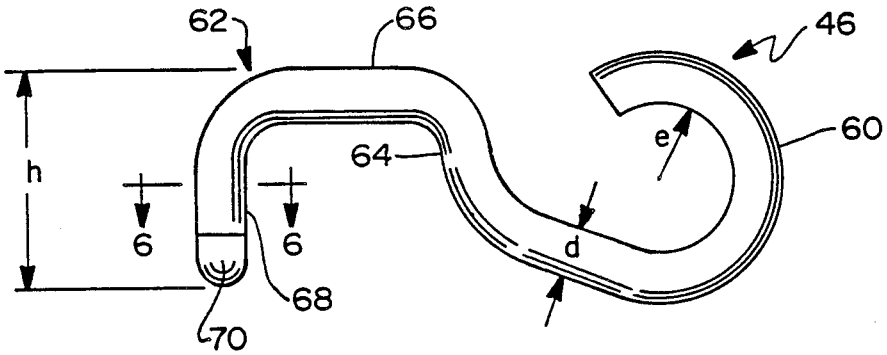
FIG.5

TILT WAND ATTACHMENT FOR WINDOW BLINDS

BACKGROUND OF THE INVENTION

Window blinds comprise an array of parallel slats that are suspended from a channel. The channel typically is mounted by brackets to an upper location near a window.

Window blinds may comprise horizontally aligned slats or vertically aligned slats. Blinds having horizontally aligned slats include flexible supports or ladders extending from the channel to support the blinds in a horizontal array. Vertical blinds typically include supports extending directly from each slat to control apparatus in the channel. The controls disposed in the channel typically are operative to permit selective expansion or collapsing of the array of slats and to permit adjustments to the angular alignment or tilt of the slats.

The tilt adjustment for horizontal blinds typically is achieved by a horizontal tilt rod rotatably mounted in the channel. The longitudinal runners of each ladder extend to opposite respective sides of mounting means on the tilt rod. Rotation of the tilt rod thus causes the longitudinal supports of the respective ladders to shift upwardly or downwardly relative to one another with corresponding and simultaneous shifts in the alignment of each slat in the array. The rotational movement of the tilt rod may be achieved by the interaction of a gear mounted to the rod with a second gear mounted to an appropriate adjustment means. The adjustment means extends from the channel to a convenient elevation for permitting adjustments to be made from the room in which the blinds are mounted.

A popular and extremely efficient actuator for adjusting the tilt of blinds comprises a tilt wand which defines an elongated rod extending from the vicinity of the channel to a convenient elevation below the channel. The tilt wand may be formed from plastic and may have longitudinally extending ribs to facilitate rotation of the wand about its longitudinal axis. The uppermost portion of the wand includes an aperture extending therethrough for receiving a hook. The hook disposed at the upper end of the wand is dimensioned to pass through a corresponding aperture in a worm shaft. More particularly, the worm shaft of the prior art blinds includes a lower end with a circular aperture extending therethrough for receiving one end of a hook which is connected to the tilt wand. The opposed end of the worm shaft defines a worm gear which is selectively engageable with the gear mounted to the tilt rod in the channel of the blind. Thus, rotation of the tilt wand about its longitudinal axis causes a corresponding rotation of the worm gear shaft about its longitudinal axis. The worm gear will thus rotate in engagement with the gear of the tilt rod to cause rotation of the tilt rod about its longitudinal axis and appropriate adjustments to the angular alignment of the blinds.

The lower end of the prior art hook connecting the tilt wand to the worm shaft has been generally J-shaped such that the wand is conveniently suspended from this J-shaped hook. The upper end of the prior art hook has defined a cylindrical cross-section with a diameter a selected amount less than the diameter of the cylindrical opening in the bottom end of the prior art worm shaft. Thus, the upper end of the prior art hook could conveniently be passed through the corresponding opening in the lower end of the worm shaft. To prevent the upper end of the prior art hook from sliding out of the aperture in the prior art worm shaft, the blinds have further included a short elastomeric sleeve which is slidable over the lower end of the worm shaft and the hook positioned therein to prevent accidental removal of the hook from the worm shaft.

This prior art assembly of window blind components has worked very well. However, the relatively small components have been very difficult to assemble without the use of special tools. In particular, final assembly of the tilt wand to the blind generally is carried out at the place of installation to facilitate shipping and installation. The hook and sleeve for connecting the tilt wand to the worm shaft generally will be packaged in a separate bag with brackets to mount the channel to the window. The hook and the elastomeric sleeve, which are each less than 1 inch in length, would often be lost while the installer is securing the mounting brackets to the window frame. In other instances, the installer would install the hook and elastomeric sleeve to the worm shaft in a manner that would prevent subsequent attachment of the tilt wand. Thus, the components would have to be disassembled and reassembled, and some could be lost in the process. Many times the hook would fall out of the aperture in the worm shaft before the assembler or installer of the blinds had an opportunity to slide the elastomeric sleeve over the assembled hook and worm shaft. An attempt to hold the hook in position on the worm shaft would substantially prevent movement of the elastomeric sleeve over the properly positioned hook. However, if the assembler or installer of the blinds moved his or her fingers away from the hook to permit relative movement between the worm shaft and the sleeve, the hook would often fall out of its required position.

Since this stage of the blind assembly typically is carried out at the place of installation, the blind manufacturer has little control over the techniques employed by the customer or installer. As a result, these small but essential hooks for connecting the tilt wand to the worm shaft are often lost. The loss of these relatively small parts renders the entire blind substantially inoperable, and therefore generates dissatisfaction among customers and installers. Furthermore, manufacturers are required to send supplemental shipments of these small components with correspondingly increased costs.

Most of the preceding explanation relates to horizontal blinds. The typical vertical blind assembly will include tilt mechanisms other than the above described tilt wands. However, some vertical blinds do incorporate tilt wands. Although the tilt mechanism for vertical blinds differs from that employed in horizontal blinds, the interconnection of tilt wands to the vertical blind tilt control yields problems similar to those encountered for horizontal blinds.

In view of the above, it is an object of the subject invention to provide an efficient interconnection between the tilt mechanism and the tilt wand for window blinds.

It is another object of the subject invention to provide a tilt wand interconnection that substantially facilitates assembly at the place of sale or the place of installation.

Another object of the subject invention is to provide a tilt wand interconnection for window blinds that substantially avoids the problem of lost components during final stages of assembly.

SUMMARY OF THE INVENTION

The subject invention is directed to the tilt control for horizontal or vertical blinds and to an assembly of blinds having such a tilt control. More particularly, the blinds comprise an array of horizontal or vertical slats which are operatively connected to a tilt control to adjust the angular alignment of the blinds. The tilt control may comprise a gear which is operatively connected to the respective slats, such that movement of the gear will generate corresponding adjustments to the angular alignment or tilt of the slats.

The tilt control of the subject invention may further comprise a connector having a pair of opposed ends. The connector may be unitarily molded from an elastomeric material. One end of the connector comprises means for engaging the tilt control such that selected movement of the connector will operate the tilt control to adjust the angular alignment of the slats incorporated into the window blinds. The means on the connector for engaging the tilt control may comprise gear means, such as a worm gear, for engaging at least one corresponding gear in the tilt control.

The opposed end of the connector comprises an aperture extending generally transversely therethrough. The aperture comprises at least one minor cross-sectional dimension portion and at least one major cross-sectional dimension portion. The minor and major cross-sectional dimensioned portions may be angularly off-set from one another relative to the axis of the transverse aperture, and/or may be axially off-set from one another relative to the axis of the aperture. The minor diameter cross-sectional portion may be defined by a pair of ribs extending generally parallel to one another on opposite sides of the transverse aperture. The ribs may be disposed at generally central locations along the length of the transverse aperture. Conversely, in certain embodiments, the connector may be formed from an elastomeric material, and the minor cross-sectional portion of the transverse aperture may be defined by a generally annular inwardly extending rib.

The tilt control of the subject invention further comprises a hook of appropriate non-linear configuration and having opposed first and second hook ends. The first hook end may be of generally J-shape and may be dimensioned to engage a corresponding aperture in an end of a tilt wand. The second end of the hook may be generally linear and may be aligned in a direction generally transverse to the longitudinal direction, which is defined as extending between the opposed ends of the hook.

The hook may be formed from a metallic material which may be of generally cylindrical cross section along most of its length. However, a portion of the hook adjacent the second end thereof is of non-cylindrical cross section to define major and minor cross-sectional dimensions. The minor cross-sectional dimension defined adjacent the second end of the hook may be substantially equal to the diameter defined by the cylindrical cross-sectioned portions of the hook. The major cross-sectional dimensions adjacent the second end of the hook may be defined by portions of the hook extending generally symmetrically outwardly from opposed sides of the cylindrical hook material.

The major cross-sectional dimension adjacent the second end of the hook exceeds the minor cross-sectional dimension of the transverse aperture extending through the connector. The minor cross-sectional dimension of the second end of the hook, however, may be less than the minor cross-sectional dimension of the transverse aperture through the connector. In certain embodiments, the major cross-sectional dimension adjacent the second end of the hook may be defined by a generally annular ridge or step in the hook adjacent the second end thereof. The annular ridge or step may be tapered or chamfered from the extreme second end of the hook to facilitate insertion of the second end of the hook into the aperture, as explained further below. This latter embodiment may be particularly adaptable to embodiments where the connector is formed from an elastomeric material that will yield in response to the gradually increasing insertion forces of the hook to permit passage of the second end of the hook therethrough. In other embodiments, the second end of the hook will be insertible into the transverse aperture by appropriately aligning the major and minor cross-sectional dimensions of the hook with the respective major and minor cross-sectional dimensions of the aperture. After a selected amount of insertion of the hook into the transverse aperture, the alignment of the hook can be changed such that the minor dimensioned portions of the aperture engage the major dimensioned portions of the hook to prevent an intended separation.

The tilt control interconnection of the subject invention may further comprise a sleeve which is slidable over the interconnection between the connector and the hook. The sleeve may be formed from an elastomeric material which closely engages portions of the hook and/or the connector.

This sleeve may initially be placed on the connector and slid to a location intermediate the opposed ends. The second end of the hook may then be snapped or otherwise secured in the aperture of the connector. The hook is dimensioned to prevent the sleeve from sliding off the connector. This subassembly of the blinds with the hook snapped or otherwise secured in the aperture of the connector and with the sleeve retained intermediate the hook and the opposed end of the connector may be shipped conveniently to customers. The customer or installer may then merely rotate or translate the first end of the hook slightly away from the connector to permit attachment of the tilt wand. The sleeve may then be urged over the second end of the hook to securely retain the hook in the connector.

BRIEF DESCRIPTION OF THE DRAWINGS

FIG. 2 is a side elevational view of a worm shaft for incorporation into the subject invention.

FIG. 4 is a cross-sectional view taken along line 4—4 in FIG. 2.

FIG. 5 is a side elevational view of a hook for use in the interconnection of the subject invention.

DETAILED DESCRIPTION OF THE PREFERRED EMBODIMENTS

Figure 1:
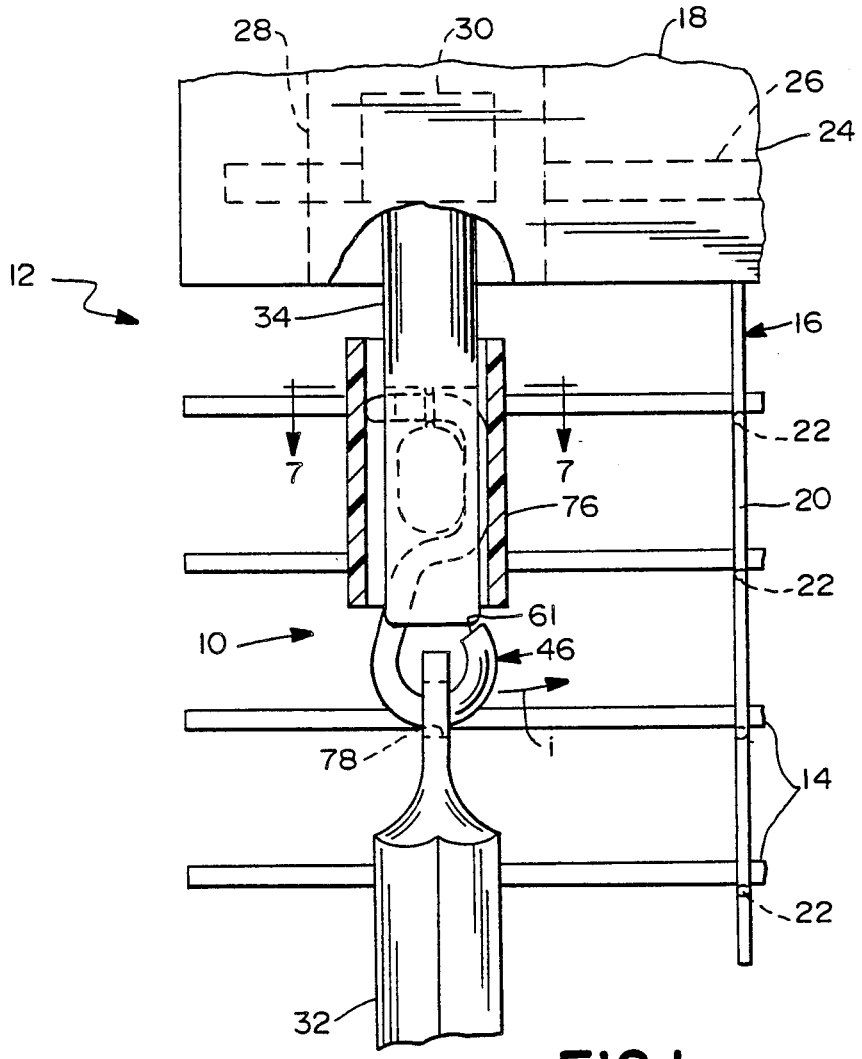
FIG. 1 is a cross-sectional view of a tilt wand interconnection in accordance with the subject invention.

The interconnection assembly of the subject invention is identified generally by the numeral 10 in FIG. 1. As illustrated in FIG. 1, the assembly 10 is used with horizontal window blinds which are identified generally by the numeral 12. As noted above, and as will be appreciated by a person skilled in this art, the interconnection assembly 10 can also be incorporated into vertical window blinds to achieve the same advantages described herein.

The blinds 12 comprise an array of generally parallel slats 14 which may formed from a thin metal material, plastic, wood or the like. The blinds are supported in their illustrated parallel array by a plurality of flexible supports or ladders 16 which suspend the slats 14 from a channel 18. The ladders 16 comprise a pair of opposed vertically extending flexible runners 20 with transversely extending supports 22 connecting the runners 20 at equally spaced locations along the respective runners 20. The supports 22 are operative to support the respective slats 14 between the runners 20 of each ladder 16. The runners 20 extend into the channel 18 and are mounted to peripheral locations on a drum 24. The drum 24 is fixedly mounted to a tilt rod 26 which, in turn, is rotatably mounted in the generally U-shaped channel 18. Thus, rotation of the tilt rod 26 about its longitudinal axis will cause the opposed vertical runners 20 of the ladder 16 to shift vertically relative to one another. This vertical shifting of the runners 20 alters the angular alignment of the respective supports 22 relative to the runners 20, to achieve corresponding adjustments to the angular alignments of the slats 14 relative to one another.

The blinds 12 further comprise a tilter 28 which is mounted in the channel 18. The tilter 28 comprises a gear which is identified generally by the numeral 30 in FIG. 1, and which is fixedly mounted to the tilt rod 26 for rotation therewith. Thus, rotation of the gear 30 about its longitudinal axis will generate a corresponding rotation of the tilt rod 26 about its axis to achieve the above described changes in the tilt of the slots 14.

Figure 3:
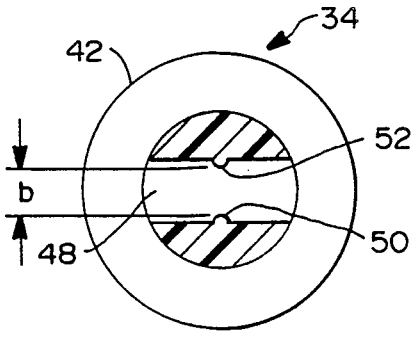
FIG. 3 is a cross-sectional view taken along line 3—3 in FIG. 2.

Rotation of the tilt rod 26 is achieved with a wand 32 which is formed from an elongated generally rigid plastic material having a non-cylindrical cross section to facilitate manipulation. The wand 32 is operatively mounted to the gear 30 of the tilt rod 26 by a connector 34. The connector 34, which is illustrated in greater detail in FIGS. 2–4, is unitarily molded from a plastic material and is of generally elongated construction. A first end 36 of the connector 34 comprises a centering means 38 for rotatable mounting in an appropriate bushing (not shown in the tilter 28). The first end 36 further comprises a worm gear 40 which is engageable with the gear 30 in the tilter 28. More particularly, rotation of the connector 34 about its longitudinal axis will cause the worm gear 40 to move relative to the tilter gear 30, thereby generating corresponding rotation of the tilt rod 26 about its longitudinal axis. The first end 36 further comprises a generally annular flange 42 which positively retains the connector 34 within the tilter 28.

Figure 6:
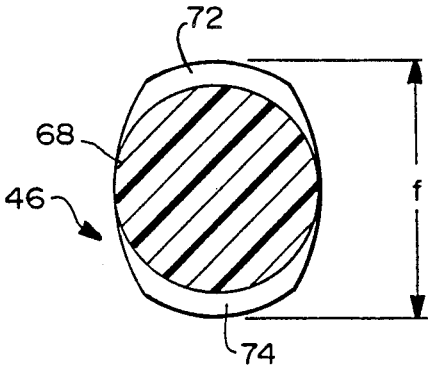
FIG. 6 is a cross-sectional view taken along line 6—6 in FIG. 5.

The second end 44 of the connector 34 is adapted to receive a double-ended connector hook 46 which is illustrated in FIG. 1 and in greater detail in FIGS. 5 and 6. As shown in FIGS. 2–4, the second end 44 of the connector 34 includes a transverse aperture 48 extending entirely therethrough. The transverse aperture 48 is of generally cylindrical configuration with a diameter "a" defining a major cross-sectional dimension for the transverse aperture 48. However, the transverse aperture 48 further comprises opposed longitudinally extending ribs 50 and 52 approximately centrally along the length of the transverse aperture 48 and aligned generally parallel to the longitudinal axis of the connector 34. The ribs 50 and 52 effectively define a minor cross section dimension "b" as shown in FIG. 3.

The connector 34 further comprises a pair of opposed longitudinally extending channels 54 and 56 which extend from the second end 44 of the connector 34 to the transverse aperture 48. More particularly, the channels 54 and 56 are substantially aligned with the opposite ends of the transverse aperture 48. The channels 54 and 56 are of generally semi-cylindrical configuration and are dimensioned to receive the hook 46 of the interconnection assembly 10 as explained further below. The connector 34 further comprises a slot 58 extending into the extreme second end 44 of the connector 34. The slot 58 defines a width substantially equal to the width "c" of the channels 54 and 56 as shown in FIG. 2.

The hook 46 of the interconnection assembly 10 is illustrated in greater detail in FIGS. 5 and 6. More particularly, the hook 46 is formed from a substantially cylindrical metal material defining a diameter "d" along a substantial portion of its length. The diameter "d" is less than the minor dimension "b" existing between the ribs 50 and 52 of the aperture 48. Preferably, the diameter "d" is approximately equal to 0.078 inch.

The hook 46 defines opposed first and second ends 60 and 62 and an intermediate portion 64. The first end 60 is of generally arcuate configuration and defines an internal radius "e" of approximately 0.109 inch. The intermediate portion 64 extends in a generally transverse direction to the length of the hook 46, and is spaced from the tip 61 of the first end 60 by a distance to enable attachment of the wand 32, as will be explained further below. The intermediate portion 64 is disposed and dimensioned for placement in the slot 58 at the end 44 of the connector 34. The second end 62 of the hook 46 includes a substantially longitudinal portion 66 which extends from the intermediate portion 64 thereof and a mounting portion 68 which extends generally transverse to the longitudinal direction of the hook 46. The mounting portion 68 is aligned generally orthogonally to the longitudinal portion 66.

The tip 70 of the second end 62 of the hook 46 is enlarged in a direction substantially transverse to the plane of the remainder of the hook 46 to define a major width "f" which is greater than the minor cross-sectional dimension "b" of the aperture 48, but which is less than or equal to the major cross-sectional dimension "a" of the aperture 48. Preferably, the major dimension "f" of the tip 70 on the hook 46 is approximately 0.098 inch. The leading end of the tip 70 is tapered and rounded to facilitate placement of the hook 46 into the connector 34 as explained further below. However, the tip 70 defines rearwardly facing locking surfaces 72 and 74 which preferably define a plane extending generally orthogonal to the mounting portion 68 of the hook 46. The overall width defined by the second end 62, is indicated by dimension "h" in FIG. 5, and preferably is approximately equal to 0.32 inch.

Returning to FIG. 1, the interconnection 10 further comprises a generally cylindrical sleeve 76 which is formed from a flexible elastomeric material and defines an inside diameter which is equal to or slightly less than the width "h" of the second end 62 of the hook 46. Preferably, dimension "h" is approximately 0.280 inch. In view of these relative dimensions, the sleeve 76 must be elastomerically deformed as it is positioned on the interconnection 10 as explained herein.

Figure 7:
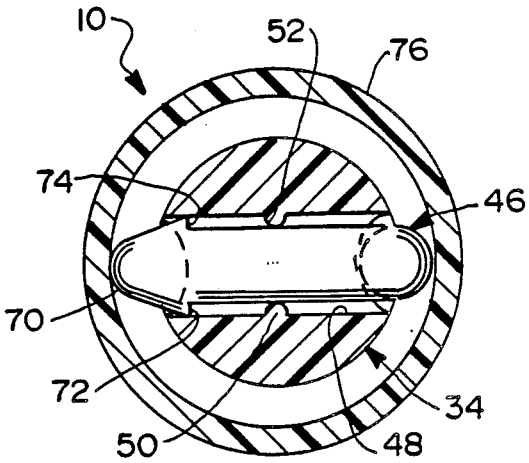
FIG. 7 is a cross-sectional view taken along line 7—7 in FIG. 1.

The assembled interconnection 10 is illustrated in FIGS. 1 and 7. In particular, the interconnection 10 is assembled by first slidably disposing the sleeve 76 over the connector 34 such that the sleeve 76 is generally adjacent the flange 42 on the first end 36 of the connector 34. The mounting portion 68 of the hook 46 is then urged into the transverse aperture 48 of the connector 34. This movement of the mounting portion 68 of the hook 46 into the transverse aperture 48 will cause the tip 70 of the mounting portion 68 to be urged into contact with the ribs 50 and 52 in the transverse aperture 48. As noted above, the leading end of the tip 70 defines an arcuate ramp, while the cross-sectional configuration of each rib 50 and 52 defines a comparable arcuate configuration. The ramping forces generated by the movement of the tip 70 against the ribs 50 and 52 will cause a deformation of the portion of the connector 34 adjacent the transverse aperture 48. More particularly, the ramping forces will cause sufficient deformation of the connector 34 to permit the enlarged tip 70 of the mounting portion 68 to clear the ribs 50 and 52. Upon sufficient insertion of the hook 46 into the transverse aperture 48, the connector 34 will elastically return to its original configuration such that the ribs 50 and 52 are disposed between the tip 70 and the longitudinal portion 66 of the hook 46. The generally planar alignment of the locking surfaces 72 and 74 of the tip 70 will substantially prevent the generation of ramping forces against the ribs 50 and 52, thereby ensuring that the connector 34 will not deform in a manner that will enable separation of the hook 46 from the connector 34. The blinds 12 may be assembled to this stage at their place of manufacture, and then sold in this partly assembled condition, with the wand 32 being separate.

The wand 32 may be mounted to the first end 60 of the hook 46 by the installer or customer of the blinds. More particularly, the arcuate first end 60 of the hook 46 may be rotated in a counterclockwise direction as indicated by arrow "i" in FIG. 1 or may be translated to the right in FIG. 1 such that the locking surfaces 72 and 74 abut the ribs 50 and 52. This spaces the tip 61 of the second end 60 a sufficient distance from the connector 34 such that the tip 61 can be passed through the aperture 78 in the wand 32, with the wand 32 thereby being suspended from the hook 46. The hook 46 next is returned to its fully seated position in the transverse aperture 48, such that the longitudinal portion 66 thereof is seated in the channel 54 or 56 and such that the intermediate portion 64 is disposed in the slot 58. The sleeve 76 is then slid longitudinally downwardly over the portion of the connector 34 in which the hook 46 is positioned. This slidable movement of the sleeve 76 will require some elastomeric deformation of the sleeve 76, such that the sleeve 76 tightly engages both the tip 70 and the longitudinal portion 66 of the hook 46, and retains the hook 46 in a substantially rigid position relative to the connector 34. It will be appreciated that the interengagement between the tip 70 and the ribs 50 and 52 positively prevents separation of the hook 46 from the connector 34 during the assembly stages where the wand 32 is being attached to the hook 46 and during the assembly stages where the sleeve 76 is being positioned.

Figure 9:
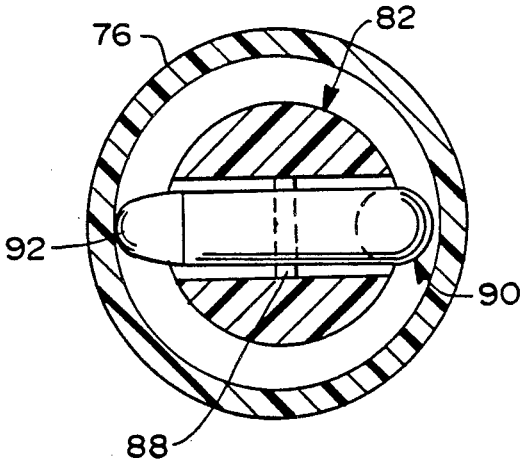
FIG. 9 is a cross-sectional view taken along line 9—9 in FIG. 8.
Figure 8:
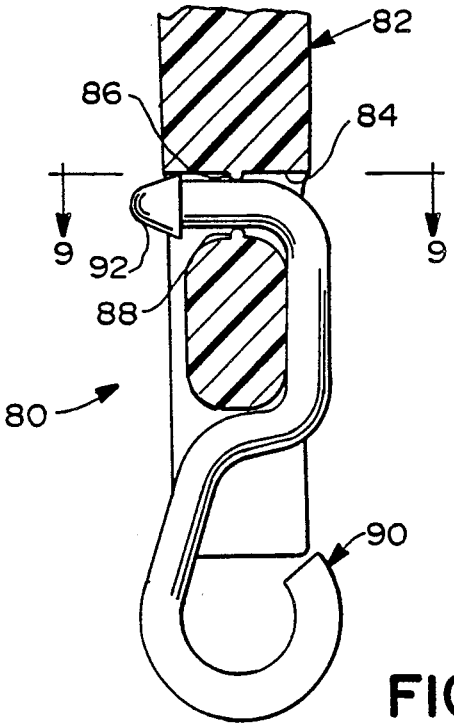
FIG. 8 is a cross-sectional view similar to FIG. 1 but showing an alternate embodiment of the subject invention.

A slightly alternate embodiment of the subject interconnection is illustrated in FIGS. 8 and 9 and is identified generally by the numeral 80. The interconnection 80 comprises a connector 82 having a transverse aperture 84 extending therethrough. The aperture 84 is characterized by ribs 86 and 88 which define a minor dimension within the transverse aperture 84. However, the ribs 86 and 88 extend transverse to the longitudinal direction of the connector 82. The interconnection 80 further comprises a hook 90 having a tip 92 with a major dimension extending generally in the plane of the hook 90. Thus, the major and minor dimensions on the connector 82 and the hook 90 are substantially 90 degrees off-set from the orientations depicted in the embodiment of FIGS. 1–7. The assembly is carried out substantially as described above. More particularly, the hook 90 is urged through the transverse aperture 84 in the connector 82 such that the ramped leading faces of the tip 92 engage the arcuate ribs 86 and 88 in the transverse aperture 84. This ramping engagement causes an elastomeric deformation of the connector 82 which enables the tip 92 to pass the ribs 86 and 88. However, the connector 82 will elastically return to the original configuration, with the ribs 86 and 88 preventing separation of the hook 90 from the transverse aperture 84.

In summary, an interconnection is provided for window blinds wherein a connector has a transverse aperture with major and minor cross-sectional dimensions. A hook is provided for mounting in the transverse aperture. The hook comprises a tapered tip which defines a major dimension that is greater than the minor dimension of the transverse aperture in the connector. Movement of the hook into the transverse aperture generates ramping forces between the tapered tip and the minor dimensioned portions of the transverse aperture, such that the connector deforms to permit passage of the major dimensioned portion of the tip, but subsequently elastically returns to its initial configuration to prevent separation of the hook from the connector. An elastomeric sleeve is selectively urged over the hook and the connector to retain the interconnection therebetween. The sleeve may initially be placed on the connector and the hook may be engaged in the transverse aperture. The blinds may be sold in this partly assembled condition for subsequent attachment of a tilt wand to the hook by the customer or installer. The elastomeric sleeve may then be urged over the hook to positively prevent movement between the hook and the connector.

While the invention has been described with respect to certain preferred embodiments, it is apparent that various changes can be made without departing from the scope of the invention as defined by the appended claims.

I claim:

1. A tilt control assembly for window blinds, said assembly comprising:

tilt control means for adjustably altering the tilt of the window blinds;

an elongated connector unitarily formed from an elastomeric material and having opposed first and second ends, the first end of the connector defining gear means operatively connected to the tilt control means, the second end of the connector comprising a transverse aperture extending therethrough and generally orthogonal to the longitudinal axis of the elongated connector, said transverse aperture being characterized by a pair of opposed unitarily molded ribs defining a minor cross-sectional dimension in said transverse aperture, said ribs being of generally arcuate cross-sectional configuration and extending into said transverse aperture to define a ramping surface;

an elongated metallic hook having opposed first and second ends and an intermediate portion therebetween, the second end of said hook comprising an elongated mounting portion extending generally transverse to the longitudinal direction of the hook, said mounting portion defining a diameter dimensioned for slidable insertion in the transverse aperture in the connector, said mounting portion including an end having a pair of opposed ramped leading faces extending into and defining a major cross-sectional dimension which is greater than the minor cross-sectional dimension of the transverse aperture in the connector, and wherein said mounting portion end has a pair of opposed non-ramped faces orthogonal to said ramped faces, said ramped leading faces of said hook further defining at least one locking surface extending generally orthogonal to the elongated mounting portion of the hook at the major cross-sectional dimension thereon, said locking surface being lockingly engageable with respect to said ribs in the transverse aperture of the connector in an operative orientation of said hook in said connector;

a generally cylindrical elastomeric sleeve engageable with the hook and the connector for retaining the hook in the transverse aperture of the connector; and an elongated tilt wand engageable with the first end of the hook, whereby the locking engagement of the end of the mounting portion of the hook with the rib in the transverse aperture of the connector securely retains the hook in the connector.

2. A tilt control assembly as in claim 1 wherein the rib extends generally parallel to the longitudinal axis of the connector.

3. A tilt control assembly as in claim 2 wherein the major dimension on the mounting portion of the hook extends generally transverse to the longitudinal direction of the hook.

4. A tilt control assembly as in claim 1 wherein the rib of the connector extends generally orthogonal to the longitudinal axis of the connector.

5. A tilt control assembly as in claim 4 wherein the major cross-sectional dimension of the hook extends generally parallel to the longitudinal direction thereof.

* * * * *